US008073570B2

(12) United States Patent
Kim et al.

(10) Patent No.: US 8,073,570 B2
(45) Date of Patent: Dec. 6, 2011

(54) HYBRID AIR-CONDITIONING SYSTEM AND METHOD FOR CONTROLLING THE SAME

(75) Inventors: Suhgoo Kim, Seongnam-si (KR); Tanabe Takeshi, Suwon-si (KR); Hyeong Joon Seo, Suwon-si (KR); Gyoung Rok Kim, Seoul (KR); Jae Hyo Jeong, Hwanseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 440 days.

(21) Appl. No.: 12/153,604

(22) Filed: May 21, 2008

(65) Prior Publication Data

US 2009/0057429 A1 Mar. 5, 2009

(30) Foreign Application Priority Data

Aug. 30, 2007 (KR) ..... 10-2007-0087489

(51) Int. Cl.

| | |
|---|---|
| ***G05B 15/02*** | (2006.01) |
| ***G05B 19/18*** | (2006.01) |
| ***G06F 19/00*** | (2006.01) |
| ***G05B 13/00*** | (2006.01) |
| ***F01P 7/02*** | (2006.01) |
| ***G05D 23/10*** | (2006.01) |
| *G05B 11/01* | (2006.01) |
| *G08B 1/00* | (2006.01) |
| *H04B 3/00* | (2006.01) |

(52) U.S. Cl. ..... 700/276; 236/35; 236/44 R; 340/309.5; 340/310.11; 340/425.2; 700/277; 700/278

(58) Field of Classification Search ..... 700/276–278, 700/9, 169; 236/25, 44 R; 340/309.5, 310.11, 340/425.2

See application file for complete search history.

(56) References Cited

U.S. PATENT DOCUMENTS

| | | | | |
|---|---|---|---|---|
| 4,122,893 | A * | 10/1978 | Thompson | 165/207 |
| 4,217,646 | A * | 8/1980 | Caltagirone et al. | 700/296 |
| 4,332,013 | A * | 5/1982 | Chelcun et al. | 700/278 |
| 4,722,044 | A * | 1/1988 | Heiser et al. | 700/65 |
| 4,819,714 | A * | 4/1989 | Otsuka et al. | 165/217 |

(Continued)

FOREIGN PATENT DOCUMENTS

KR 10-0722271 5/2007

OTHER PUBLICATIONS

Neugebauer et al.,"Automated Modeling of LonWorks Building Automation Networks", 2004, IEEE, pp. 113-118.*

(Continued)

*Primary Examiner* — Albert Decady
*Assistant Examiner* — Thomas Stevens
(74) *Attorney, Agent, or Firm* — Staas & Halsey LLP

(57) ABSTRACT

An unified controller for controlling a plurality of air-conditioning systems which are capable of air-conditioning individual air-conditioning rooms of a building using different schemes. The unified controller is located under a Building Management System (BMS) controller which simultaneously manages a plurality of systems corresponding to arrangements of the building, and simultaneously controls a multiple air-conditioning system acting as one of the air-conditioning systems and a central air-conditioning system acting as the other one of the air-conditioning systems using a single control command. The unified controller performs error correction, addition of a new function, and update of pre-loaded functions upon receiving a request from the remote controller.

19 Claims, 6 Drawing Sheets

U.S. PATENT DOCUMENTS

| | | | | |
|---|---|---|---|---|
| 4,931,948 | A * | 6/1990 | Parker et al. | 700/277 |
| 5,528,215 | A * | 6/1996 | Siu et al. | 340/286.01 |
| 5,566,879 | A * | 10/1996 | Longtin | 236/46 R |
| 5,682,949 | A * | 11/1997 | Ratcliffe et al. | 165/209 |
| 5,793,646 | A * | 8/1998 | Hibberd et al. | 700/276 |
| 5,818,347 | A * | 10/1998 | Dolan et al. | 340/825.52 |
| 6,967,565 | B2 * | 11/2005 | Lingemann | 340/310.11 |
| 7,343,226 | B2 * | 3/2008 | Ehlers et al. | 700/276 |
| 7,676,300 | B2 * | 3/2010 | Kim et al. | 700/276 |
| 2004/0117069 | A1 * | 6/2004 | Yoon et al. | 700/276 |

OTHER PUBLICATIONS

Tipsuwanporn et al., "Development of Load Control and Management System", 2002, IEEE, pp. 2139-2142.*

Tse et al., "Emergency Lighting Monitoring System Using LonWorks", 2003, Elsevier, p. 617-629.*

* cited by examiner

FIG. 1 – PRIOR ART

FIG. 2 – PRIOR ART

HYBRID AIR-CONDITIONING SYSTEM AND METHOD FOR CONTROLLING THE SAME

CROSS-REFERENCE TO RELATED APPLICATIONS

This application claims the benefit of Korean Patent Application No. 2007-0087489, filed on Aug. 30, 2007 in the Korean Intellectual Property Office, the disclosure of which is incorporated herein by reference.

BACKGROUND

1. Field

The present invention relates to a hybrid air-conditioning system for simultaneously controlling a plurality of air-conditioning systems of different types, and a method for controlling the same.

2. Description of the Related Art

Generally, as building arrangements are rapidly modernized, a building control system for automatically controlling various arrangements (e.g., air-conditioning, power, iiiumination, and protection arrangements) has been widely used throughout the world.

In recent times, the building control system is not limited to automate the above-mentioned systems (e.g., air-conditioning, power, illumination, entrance control, gauge examination) but rather, individual systems are organically integrated to implement an effective network. In this case, in order to effectively integrate the individual systems, the integration of the individual systems must be implemented by an open-type technology instead of the conventional technology developed by a specific company. And, the individual systems must be organically interconnected under a lower control network, instead of being incompletely integrated at an upper part.

Generally, the building control system includes a building management system (BMS) controller for simultaneously controlling the individual systems using the LONWORKS network technology. LONWORKS is a registered trademark of the Echelon Corporation and is a communications scheme specifically created to address the needs of control applications. The LONWORKS communications scheme is built on a protocol that has been adapted as a standard by the American National Standards Institute (ANSI) for control networking in 1999 (ANSI/CEA-709.1-B). Upon receiving a control signal from the BMS controller, the individual systems can perform their unique functions.

In association with the air-conditioning of a large-sized building, the central air-conditioning system has been widely used to divisionally provide inner rooms of the building with the conditioned air via an air duct. In recent times, a hybrid air-conditioning system includes not only the central air-conditioning system but also a multiple air-conditioning system in a single building, so that different air-conditioning schemes are applied to individual installation spaces, resulting in the implementation of effective air-conditioning of all areas of the building.

FIG. 1 is a block diagram illustrating a conventional hybrid air-conditioning system. FIG. 2 is a detailed block diagram illustrating the hybrid air-conditioning system of FIG. 1.

Referring to FIGS. 1 and 2, the BMS controller is connected to a plurality of systems 20, 30, 40, and 50 associated with individual building arrangements. In this case, similar to the conventional art, so that it simultaneously manages the air-conditioning function, the illumination control function, the power control function, and other control functions of additional arrangements (not shown).

The multiple air-conditioning system 20 connects a plurality of indoor units 23 and 25 installed in individual air-conditioning rooms to a single outdoor unit 22, so that it can perform the multiple air-conditioning of the individual air-conditioning rooms. In this case, information acquired by sensors 24 and 26 for detecting environmental information (e.g., temperature and humidity) is transmitted to the multiple air-conditioning system 21 by wire 11.

The central air-conditioning system 30 includes a plurality of sensor nodes 32 and 34 installed in the individual air-conditioning rooms to collect the information acquired from the sensors 33 and 35. The central air-conditioning system 30 further includes a central air-conditioning system controller 31 connected to the air-adjusting damper 36, so that it controls the air-conditioning operation according to the central air-conditioning scheme. In this case, the air-adjusting damper 36 is open or closed to control the flow of air, or may adjust an opening degree.

The illumination system 40 includes an illumination controller 41 for controlling a plurality of lamps 42 and 43 installed in the individual air-conditioning rooms.

The power system includes a power controller 51 for operating a plurality of power-control switches 52 and 53 installed in the individual air-conditioning rooms.

It should be noted that all the systems of the BMS may have different communication schemes. For example, the multiple air-conditioning system 20 may perform data communication between the different systems using the RS485 communication scheme. The central air-conditioning system 30 may perform data communication between the different systems using the LONWORKS communication scheme.

The BMS controller 10 communicates with each of the multiple air-conditioning system controller 21 and the central air-conditioning system controller 31, so that the air-conditioning operation of the individual air-conditioning systems are simultaneously managed.

The individual air-conditioning systems use different communication schemes, so that it is difficult to control the air-conditioning systems using the same control command, and different air-conditioning patterns are applied to the individual air-conditioning systems, resulting in deterioration of compatibility. Therefore, although the BMS controller simultaneously manages the two air-conditioning systems, it can only interconnect the two air-conditioning systems without performing other functions, so that the efficiency is deteriorated and the costs for operating the air-conditioning systems are increased. For example, if a malfunction occurs in the network or a disconnection of the network occurs, the individual air-conditioning systems cannot easily communicate with the BMS controller, so that the individual air-conditioning systems may perform abnormal control operations. Therefore, if the air-conditioning operation is inappropriately controlled, the efficiency deterioration caused by unnecessary air-conditioning occurs and unnecessary costs are consumed.

Sensors installed in individual air-conditioning rooms are connected to the controller by wire, so that information detected by the sensors is transmitted to the controller. In order to change locations of the sensors to other locations, a task for changing a wiring to another wiring is required, resulting in greater inconvenience of use.

Sensors for detecting environmental information (e.g., temperature and humidity) are installed in two air-conditioning systems, and the processing of the sensor information is divided into two parts, resulting in a deterioration of control efficiency. For example, the multiple air-conditioning system uses an integer-type temperature sensor, and the central air-conditioning system uses a real-number-type temperature sensor, so that it is difficult to optimally control the multiple and central air-conditioning systems.

The conventional hybrid air-conditioning system includes different air-conditioning systems, so that it is difficult to monitor status information of the air-conditioning systems or change their function, resulting in a deterioration of system reliability.

SUMMARY

Therefore, it is an aspect of the invention to provide a method for effectively managing air-conditioning of a total area of a building using a single unified controller compatible with a plurality of air-conditioning systems capable of applying different communication schemes to a building control system.

It is another aspect of the invention to provide a method for applying sensor information acquired by wireless communication between each controller of individual air-conditioning systems and each sensor to an air-conditioning control operation, easily changing a position of the sensor, and processing the sensor information using a single scheme.

It is another aspect of the invention to provide a method for monitoring an air-conditioning system at a remote site system simultaneously while changing a function of the air-conditioning system to another function, and easily operating and maintaining the air-conditioning system.

Additional aspects and/or advantages of the invention will be set forth in part in the description which follows and, in part, will be apparent from the description, or may be learned by practice of the invention.

In accordance with the invention, the above and/or other aspects can be achieved by the provision of a hybrid air-conditioning system including: a Building Management System (BMS) controller which simultaneously manages a plurality of systems corresponding to individual arrangements of a building; a multiple air-conditioning system which installs a plurality of indoor units connected to a single outdoor unit in individual air-conditioning rooms, and performs air-conditioning of the individual air-conditioning rooms according to a multiple air-conditioning scheme; a central air-conditioning system which provides the individual air-conditioning rooms with air air-conditioned via an air-duct; and an unified controller which communicates with the individual air-conditioning systems simultaneously while being compatible with different communication schemes of the multiple air-conditioning system and the central air-conditioning system, and simultaneously controls an overall air-conditioning of the building.

The individual air-conditioning systems may commonly include an environmental sensor for detecting environmental information of the individual air-conditioning rooms, and a sensor node for wirelessly collecting sensor information detected by the environmental sensor.

The environmental sensor may detect at least one of temperature and humidity.

The unified controller may be located under the BMS controller, and control the individual air-conditioning systems independent of the BMS controller.

The unified controller may include an open network structure, which is capable of being compatible with a RS 485 communication scheme applied to the multiple air-conditioning system and a LONWORKS communication scheme applied to the central air-conditioning system.

The unified controller may include: an application program equipped with a plurality of modularized applications; a middleware equipped with a gateway program based on an embedded Java environment to perform multiple services irrespective of the application program; and a basic resource.

The application program may include: a control application which controls an application the application loaded on the unified controller; a LONWORKS application which allows the unified controller and the central air-conditioning system to communicate with each other according to the LONWORKS communication scheme; and an RS485 application which allows the unified controller and the multiple air-conditioning system to communicate with each other according to the RS485 communication scheme.

The middleware may include: an Open Service Gateway Initiative (OSGI) LONWORKS system which processes control messages between the unified controller and the central air-conditioning system; an OSGI network system which processes control messages between the unified controller and the multiple air-conditioning system; and an embedded Java (J2ME).

The basic resource may include an embedded Database Management System (DBMS) and an embedded Operating System (OS).

The system may further include a remote controller connected to the unified controller in order to remotely control the unified controller.

The remote controller may be implemented with an Internet server or a personal computer.

The remote controller may be connected to the unified controller, so that it corrects errors of the unified controller, adds a new function to the unified controller, and updates pre-loaded functions of the unified controller.

In accordance with another aspect of the present invention, there is provided a hybrid air-conditioning system including: a Building Management System (BMS) controller which simultaneously manages a plurality of arrangements installed in a building; a first air-conditioning system including a first air-conditioning system controller, which communicates with a first air-conditioning area of the building according to a first communication scheme and performs air-conditioning of the first air-conditioning area according to a multiple air-conditioning scheme; a second air-conditioning system including a second air-conditioning system controller, which communicates with a second air-conditioning area of the building according to a second communication scheme and performs air-conditioning of the second air-conditioning area according to a central air-conditioning scheme; and an unified controller which is connected to each of the first and second air-conditioning system controllers, and independently controls the first and second air-conditioning controllers at a location lower than that of the BMS controller.

The first communication scheme may be an RS485 communication scheme.

The second communication scheme may be a LONWORKS communication scheme.

The first air-conditioning system may perform air-conditioning of an outer area of a first building having a large amount of cooling or heating load variation; the second air-conditioning system may perform air-conditioning of an inner area of a second building having a small amount of cooling or heating load variation.

The system may further include a remote controller which is connected to the unified controller, corrects errors of the first and second air-conditioning system controllers, adds a new function to them, and updates pre-loaded functions of them.

In accordance with another aspect of the present invention, there is provided a method for controlling a hybrid air-conditioning system which includes a Building Management System (BMS) controller for simultaneously controlling a plurality of arrangements installed in a building and an unified controller for simultaneously controlling a plurality of air-conditioning systems of different types, the method including: receiving, by the unified controller, at least one control message from controllers of the air-conditioning systems; upon receiving the control message, determining category information of the received control message; determining whether an air-conditioning operation of one air-conditioning system selected from among the air-conditioning systems is required or not according to the determined category information of the control message; transmitting a message for operating or stopping the selected air-conditioning systems to a corresponding air-conditioning system according to the determined result; and controlling an air-conditioning operation upon receiving the message from the air-conditioning system.

The method may further include if the determined category information of the control message is a multiple air-conditioning system serving as one of the air-conditioning systems, performing the air-conditioning operation according to a multiple air-conditioning scheme using a plurality of indoor units, which are connected to a single outdoor unit and at least one of the indoor units is installed in individual air-conditioning rooms.

The method may further include if the determined category information of the control message is a central air-conditioning system serving as one of the air-conditioning systems, providing individual air-conditioning rooms with conditioned air via an air duct, and air-conditioning of the individual air-conditioning rooms according to a central air-conditioning scheme.

During the air-conditioning operation, the individual air-conditioning systems may transmit control messages associated with sensor information detected by a sensor which detects environment information of the individual air-conditioning rooms to the unified controller.

The method may further include if there is a need for a remote controller to be connected to the unified controller according to the determined category information of the control message, connecting the unified controller to the remote controller, and if the unified controller is connected to the remote controller, performing error correction of the unified controller, addition of a new function, and update of preloaded functions upon receiving a request from the remote controller.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
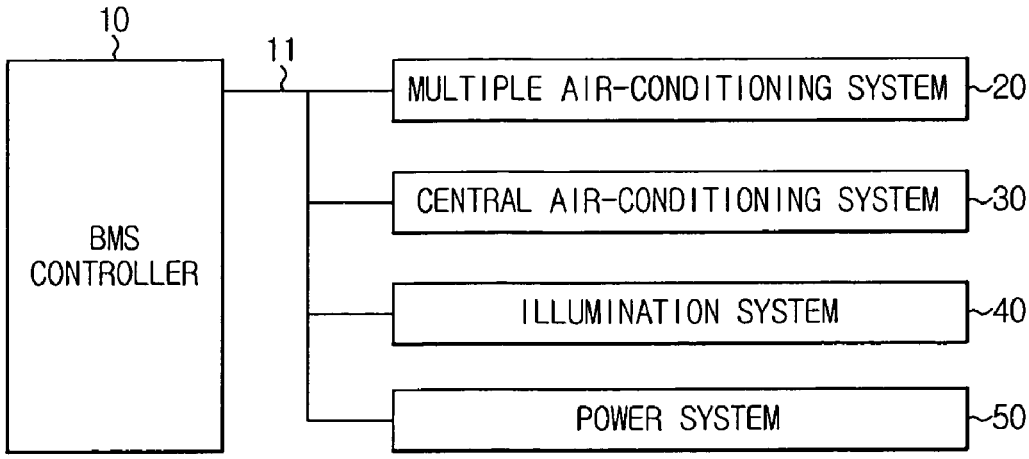
FIG. 1 is a block diagram illustrating a conventional hybrid air-conditioning system.
Figure 2:
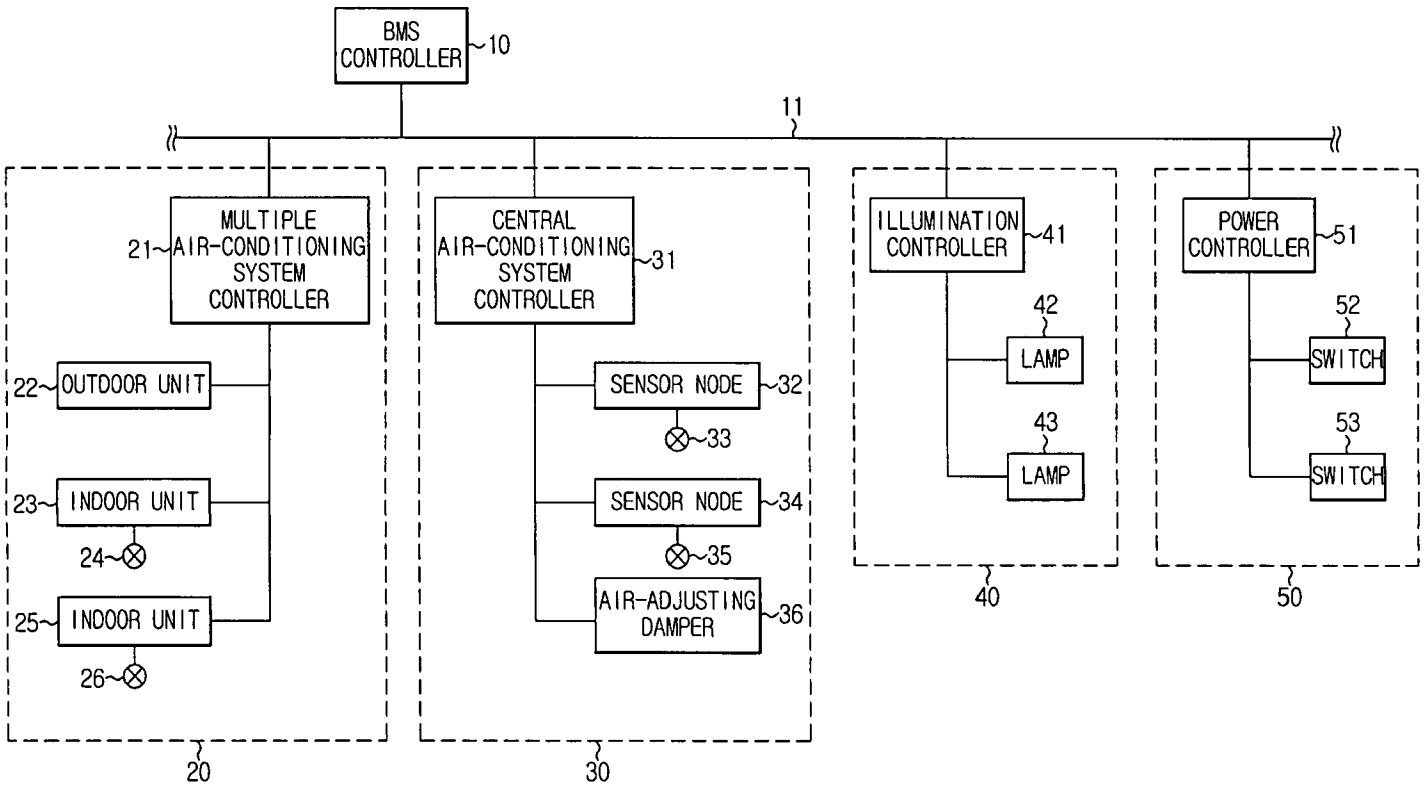
FIG. 2 is a detailed block diagram illustrating the hybrid air-conditioning system of FIG. 1.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 3:
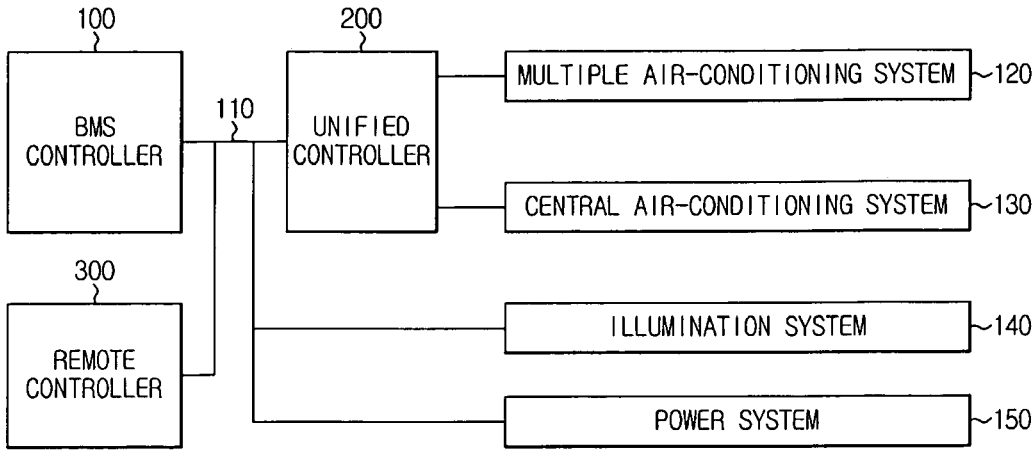
FIG. 3 is a block diagram illustrating a hybrid air-conditioning system according to the present invention.
Figure 4:
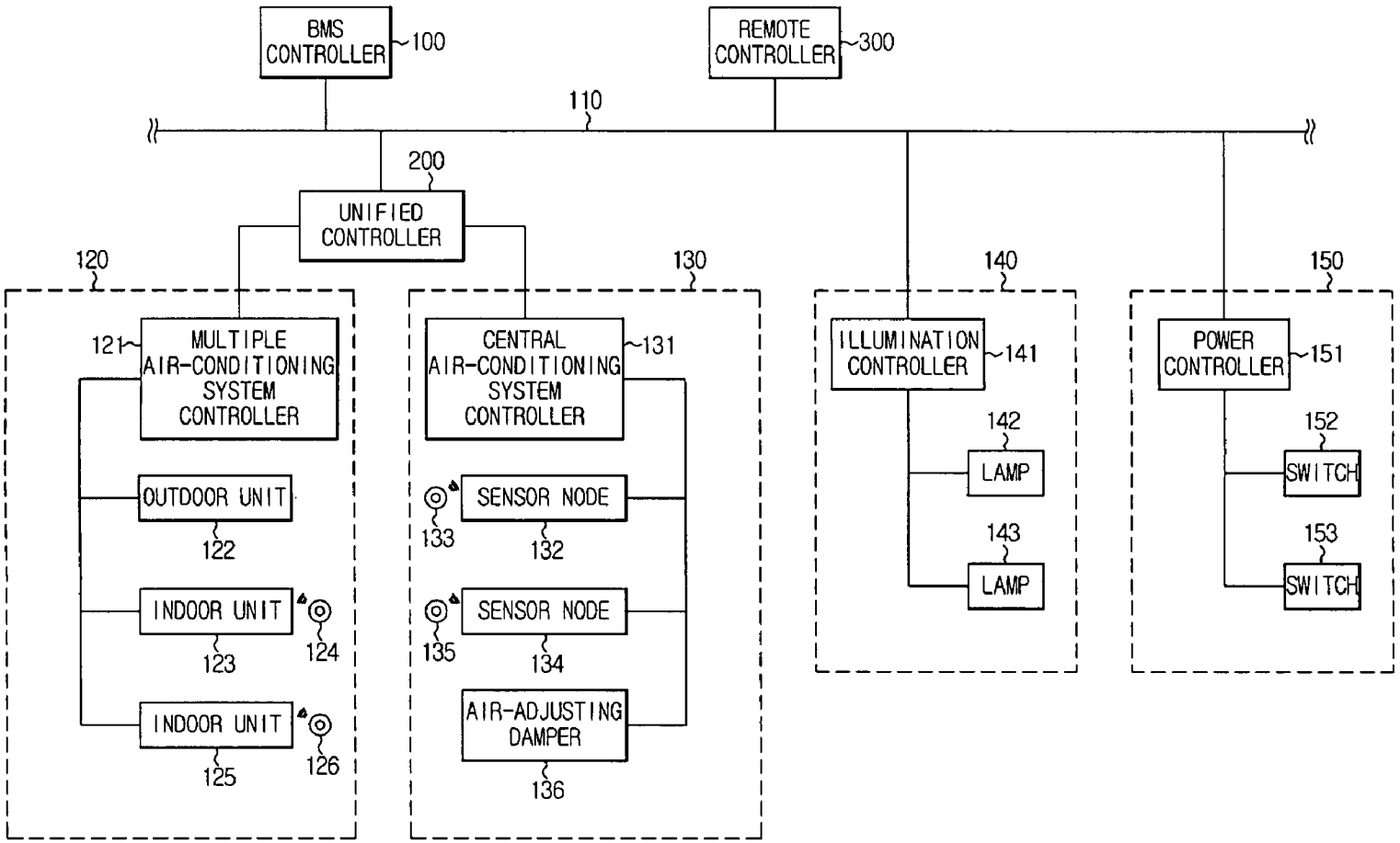
FIG. 4 is a detailed block diagram illustrating the hybrid air-conditioning system of FIG. 3 according to the present invention.
Figure 5:
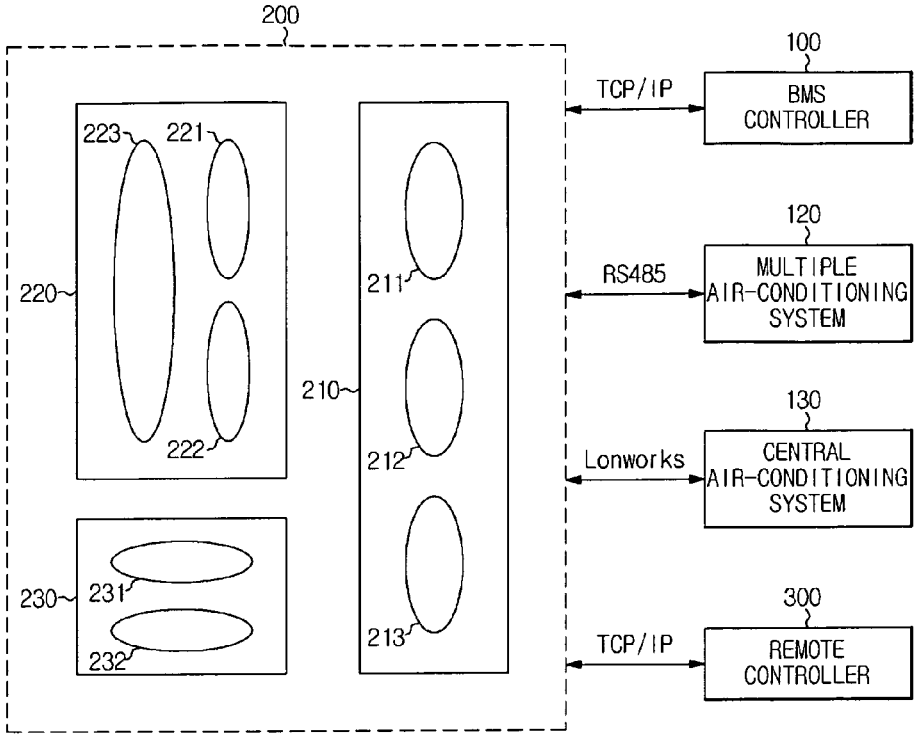
FIG. 5 is a detailed block diagram illustrating an integrated controller of FIG. 3 according to the present invention.

FIG. 3 is a block diagram illustrating a hybrid air-conditioning system according to the present invention. FIG. 4 is a detailed block diagram illustrating the hybrid air-conditioning system of FIG. 3 according to the present invention. FIG. 5 is a detailed block diagram illustrating an integrated controller of FIG. 3 according to the present invention.

Referring to FIG. 3, the hybrid air-conditioning system according to the present invention includes a BMS controller 100 and a plurality of systems 120, 130, 140, and 150 associated with individual building arrangements. In this case, similar to the conventional art, the individual systems perform the air-conditioning function, the illumination function, and the power function, respectively.

The BMS controller 100 is connected to the illumination system 140 and the power system 150 over a network 110. Specifically, the BMS controller 100 is connected to the multiple air-conditioning system 120 and the central air-conditioning system 130 via the unified controller 200.

The BMS controller 100 is connected to the unified controller 200, the illumination controller 141, and the power controller 151 over the network.

The unified controller 200 is connected to the remote controller 300 over the network 110.

The remote controller 300 is connected to the unified controller 200, and can be implemented with various devices for a remote control. For example, the remote controller 300 may be implemented with an Internet server or a personal computer (PC).

Referring to FIG. 4, the hybrid air-conditioning system can simultaneously control the multiple air-conditioning system 120 and the central air-conditioning system 130 to perform air-conditioning of a total area of the building. The multiple air-conditioning system 120 and the central air-conditioning system 130 are based on different communication schemes.

Preferably, the multiple air-conditioning system 120 performs air-conditioning of an outer area of a first building having a large amount of cooling or heating load variation. The central air-conditioning system 130 performs air-conditioning of an inner area of a second building having a small amount of cooling or heating load variation.

The multiple air-conditioning system 120 includes a multiple air-conditioning system controller 121 for controlling the air-conditioning operation using a multiple air-conditioning scheme.

The multiple air-conditioning system controller 121 is connected to a single outdoor unit 122 and a plurality of indoor units 123 and 125 installed in individual air-conditioning rooms. In this case, the individual indoor units 123 and 125 include sensors 124 and 126 for detecting environmental information (e.g., temperature and humidity), and sensor nodes (not shown) for receiving information wirelessly transmitted from the sensors 124 and 126. The information collected by the sensor node is transmitted to the multiple air-conditioning system controller 121.

The central air-conditioning system 130 includes a central air-conditioning system controller 131 capable of controlling the air-conditioning operation using a central air-conditioning scheme.

The central air-conditioning system controller 131 is connected to a plurality of sensor nodes 132 and 134 installed in individual air-conditioning rooms, and is also connected to an air-adjusting damper 136 installed in an air-duct capable of providing the individual air-conditioning rooms with the conditioned air.

The sensor nodes 132 and 134 are installed in the individual air-conditioning rooms, collect information detected by the sensors 133 and 135 detecting the environmental information (e.g., temperature and humidity), and transmit the collected information to the central air-conditioning system controller 131. In this case, the sensor nodes 132 and 134 wirelessly communicates with the sensors 133 and 135, and receive sensing information from the sensors 133 and 135, respectively.

The air-adjusting damper 136 is open or closed by a control signal of the central air-conditioning system controller 131, or its opening degree is controlled by the central air-conditioning system controller 131, so that it allows the individual air-conditioning rooms to receive the conditioned air.

The illumination system 140 includes an illumination controller 141 for controlling operations of at least one of the lamps 142 and 143 installed in the individual air-conditioning rooms.

The power system 150 includes a power controller 151 for controlling operations of the power-control switches 152 and 153 installed in the individual air-conditioning rooms.

As described above, the unified controller 200 is connected between the air-conditioning systems 120 and 130 based on different communication schemes.

The unified controller 200 is located between the multiple air-conditioning system controller 121 and the central air-conditioning system controller 131, thereby simultaneously controlling the air-conditioning operation of a total area of the building.

For the above-mentioned operation, the unified controller 200 is compatible with different communication schemes, and has a system structure capable of communicating with the individual controllers 100, 120, 130, and 300 over an open network.

Referring to FIG. 5, the system structure of the unified controller 200 mainly includes the application program 210, the middleware 220, and the basic resource 230.

The application program 210 includes the control application 211, the LONWORKS application 212, and the RS485 application 213.

The control application 211 is adapted to control the application of the unified controller. The LONWORKS application 212 enables the unified controller to communicate with the central air-conditioning system 130 according to the LONWORKS communication scheme. The RS485 application 213 enables the unified controller to communicate with the multiple air-conditioning system 120 according to the RS485 communication scheme.

The middleware 220 includes an Open Service Gateway Initiative (OSGI) LONWORKS system 221, an OSGI network system 222, and an embedded Java (J2ME) 223.

Each of the OSGI LONWORKS system 221 and the OSGI network system 222 is a gateway program based on an embedded Java 223, and performs multiple services irrespective of the application program. The middleware 220 serves as a gateway based on an embedded Java suitable for the OSGI standard, so that it can simultaneously control the multiple air-conditioning system and the central air-conditioning system using a single control command. In this case, the OSGI LONWORKS system 221 processes a control message between the unified controller and the central air-conditioning system. The OSGI network system 222 processes a control message between the unified controller and the multiple air-conditioning system.

The basic resource 230 includes an embedded Database Management System (DBMS) 231 and an embedded Operating System (OS) 232 which are capable of being operated under an embedded Java environment (J2ME).

The unified controller 200 transmits or receives a control message to/from the BMS controller 100 and the remote controller 300 according to the TCP/IP communication scheme. The unified controller 200 transmits or receives a control message to/from the multiple air-conditioning system controller 121 according to the RS485 communication scheme. The unified controller 200 transmits or receives a control message to/from the central air-conditioning system controller 131 according to the LONWORKS communication scheme.

The unified controller 200 collects control message received from the controllers of the individual air-conditioning systems at ordinary times. The unified controller 200 determines status information of either the multiple air-conditioning system or the central air-conditioning system according to the received control message, and transmits an operation- or stop-message according to the determined result.

Although an abnormal situation occurs by errors of the BMS controller or disconnection of the network 110, the unified controller 200 is located between the upper BMS controller and the air-conditioning systems 120 and 130, and controls the air-conditioning systems independent of the BMS controller, so that it can perform air-conditioning of all areas of the building.

If the unified controller 200 receives a connection request from the remote controller 300, it allows the remote controller 300 to perform error correction, addition of a new function, and update operation. In this case, individual constituent parts of the system structure of the unified controller are modularized, so that the unified controller may add a new function suitable for the air-conditioning system using a remote control function or may update pre-loaded functions using the same.

Figure 6:
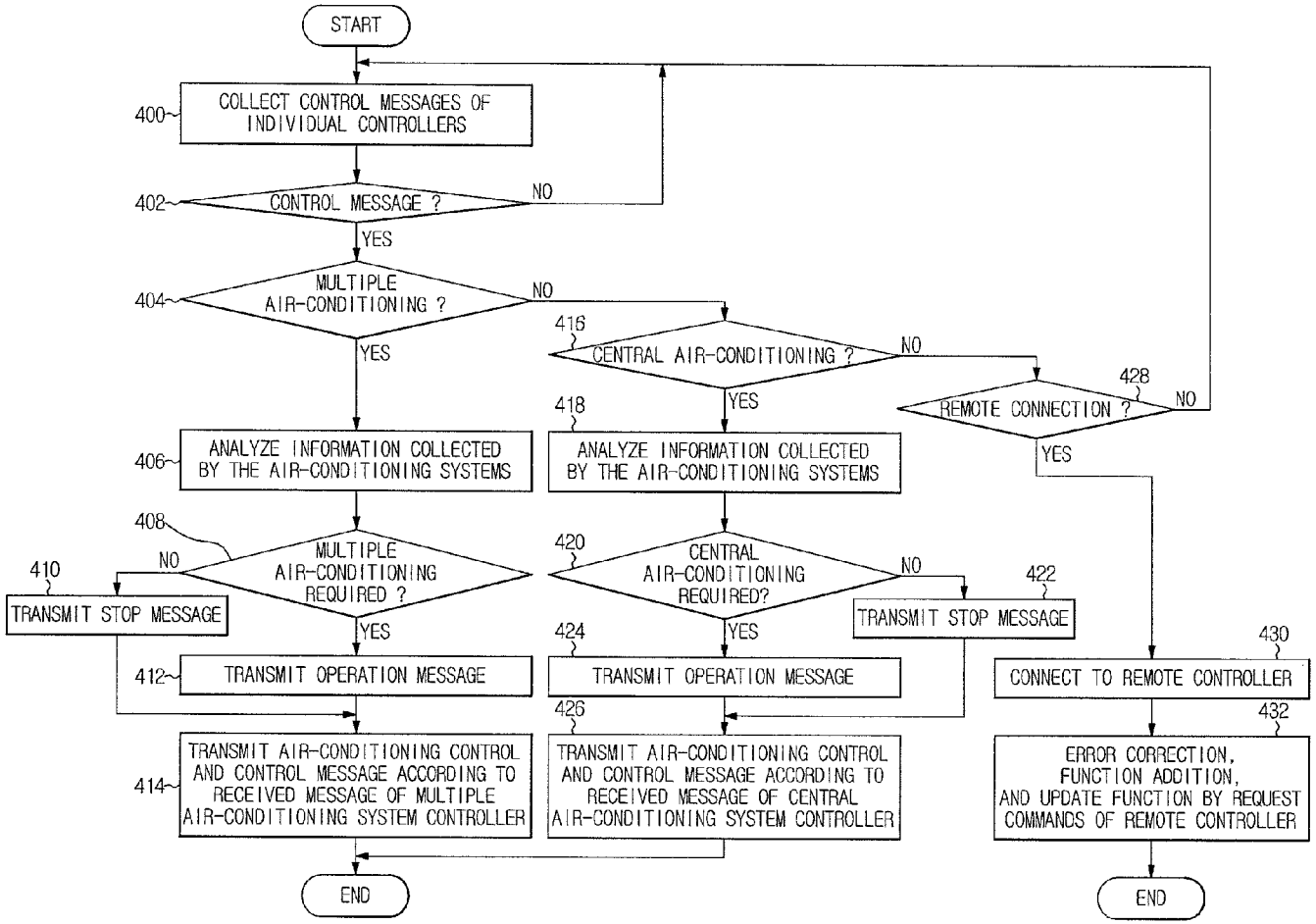
FIG. 6 is a flow chart illustrating a control method of the hybrid air-conditioning system according to the present invention.

Referring to FIG. 6, a method for controlling the hybrid air-conditioning system according to the present invention will hereinafter be described in detail.

The unified controller 200 receives control messages from the BMS controller 100, the remote controller 300, and the controllers 121 and 131 of the individual air-conditioning systems contained in the hybrid air-conditioning system at operation 400.

The unified controller 200 determines whether the control message has been received from either one of the controllers at operation 402. If the control message has been received, the unified controller 200 determines that the received control message is a multiple air-conditioning control message at operation 404.

If the multiple air-conditioning control message has determined at operation 404, the unified controller 200 analyzes information collected by the controllers 121 and 131 of the individual air-conditioning systems at operation 406, and determines whether the multiple air-conditioning operation is required or not at operation 408. In this case, in order to determine the necessity of the multiple air-conditioning operation at operation 408, environmental information (e.g., temperature and humidity) of the individual air-conditioning rooms may be compared with a reference value. This reference value may be modified in various ways according to a variety of operation conditions or environments of the individual air-conditioning systems.

If the multiple air-conditioning operation is not required at operation 408, the unified controller 200 transmits the stop message to the multiple air-conditioning system controller 121 at operation 410. If the multiple air-conditioning operation is required at operation 408, the unified controller 200 transmits an operation message to the multiple air-conditioning system controller 121 at operation 412.

Then, the multiple air-conditioning system controller 121 may stop the multiple air-conditioning operation upon receiving the stop message from the unified controller 200, or may begin the multiple air-conditioning operation upon receiving the operation message from the unified controller 200. During this air-conditioning time, the multiple air-conditioning system controller 121 transmits a control message of the sensor information collected by the sensors 124 and 126 to the unified controller 200, so that the control message can be reflected in the following air-conditioning operation of the building at operation 414. Then, the above-mentioned operations are repeated.

If the multiple air-conditioning control message is not determined at operation 404, the unified controller 200 determines whether the received control message is the central air-conditioning control message at operation 416. If the central air-conditioning control message is determined, the unified controller 200 analyzes information collected by the controllers 121 and 131 of the individual air-conditioning systems at operation 418, and determines whether the central air-conditioning operation is required or not at operation 420. In this case, in order to determine the necessity of the central air-conditioning operation at operation 420, environmental information (e.g., temperature and humidity) of the individual air-conditioning rooms may be compared with a reference value. This reference value may be modified in various ways according to a variety of operation conditions or environments of the individual air-conditioning systems.

If the central air-conditioning operation is not required at operation 420, the unified controller 200 transmits the stop message to the central air-conditioning system controller 131 at operation 422. If the central air-conditioning operation is required at operation 420, the unified controller 200 transmits an operation message to the central air-conditioning system controller 131 at operation 424.

The central air-conditioning system controller 131 may stop the central air-conditioning operation upon receiving the stop message from the unified controller 200, or may begin the central air-conditioning operation upon receiving the operation message from the unified controller 200. During this air-conditioning time, the central air-conditioning system controller 131 transmits a control message of the sensor information collected by the sensors 124 and 136 to the unified controller 200, so that the control message can be reflected in the following air-conditioning operation of the building at operation 426. Then, the above-mentioned operations are repeated.

If the central air-conditioning control message is not determined at operation 416, the unified controller 200 determines whether the received control message is associated with the remote connection request at operation 428. If the remote connection request control message is determined, the unified controller 200 is connected to the remote controller 300 at operation 430. In this case, a general authentication procedure of the remote controller may be used.

If the unified controller is connected to the remote controller, the unified controller receives a request command from the remote controller, so that it performs error correction, addition of a new function, and update of pre-loaded functions in association with the modularized application and other programs loaded in the unified controller 200 at operation 432. Then, the above-mentioned operations are repeated.

As is apparent from the above description, the present invention can stably and effectively control the hybrid air-conditioning system installed in a building using a single unified controller connected to both a multiple air-conditioning system and a central air-conditioning system although unexpected errors occur in the BMS controller or an upper network.

The present invention transmits sensor information acquired by a wireless-type sensor to an upper controller, collects the received sensor information, and processes the sensor information using a single scheme, so that it can easily change positions of sensors installed in the building to other positions and can increase the accuracy of the sensor processing operation.

The present invention connects the remote controller to the single unified controller, and processes error correction, addition of a new function, and update of pre-loaded functions at a remote site, so that it can easily maintain the air-conditioning system and reduce the costs of system operation.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A hybrid air-conditioning system comprising:

a Building Management System (BMS) controller which simultaneously manages a plurality of systems corresponding to individual arrangements of a building;

a multiple air-conditioning system which installs a plurality of indoor units connected to a single outdoor unit in individual air-conditioning rooms, and performs air-conditioning of the individual air-conditioning rooms according to a multiple air-conditioning scheme;

a central air-conditioning system which provides the individual air-conditioning rooms with air air-conditioned via an air-duct;

an unified controller which communicates with the individual air-conditioning systems simultaneously while being compatible with different communication schemes of the multiple air-conditioning system and the central air-conditioning system, and simultaneously controls an overall air-conditioning of the building; and a remote controller connected to the unified controller to remotely control the unified controller, wherein the individual air-conditioning systems commonly include an environmental sensor to detect environmental information of the individual air-conditioning rooms, and a sensor node to wirelessly collect sensor information detected by the environmental sensor.

2. The system according to claim 1, wherein the environmental sensor detects at least one of temperature and humidity.

3. The system according to claim 1, wherein the unified controller is located under the BMS controller, and controls the individual air-conditioning systems independent of the BMS controller.

4. A hybrid air-conditioning system comprising:

a Building Management System (BMS) controller which simultaneously manages a plurality of systems corresponding to individual arrangements of a building;

a multiple air-conditioning system which installs a plurality of indoor units connected to a single outdoor unit in individual air-conditioning rooms, and performs air-conditioning of the individual air-conditioning rooms according to a multiple air-conditioning scheme;

a central air-conditioning system which provides the individual air-conditioning rooms with air air-conditioned via an air-duct; and an unified controller which communicates with the individual air-conditioning systems simultaneously while being compatible with different communication schemes of the multiple air-conditioning system and the central air-conditioning system, and simultaneously controls an overall air-conditioning of the building, wherein the unified controller includes an open network structure, which is capable of being compatible with a RS 485 communication scheme applied to the multiple air-conditioning system and a ANSI/CEA-709.1-B communication scheme applied to the central air-conditioning system, wherein the communication scheme conforms with the American National Standards Institute (ANSI) standard protocol for control networking ANSI/CEA-709.1-B.

5. The system according to claim 4, wherein the unified controller includes:

an application program equipped with a plurality of modularized applications;

a middleware equipped with a gateway program based on an embedded Java environment to perform multiple services irrespective of the application program; and a basic resource.

6. The system according to claim 5, wherein the application program includes:

a control application which controls an application the application loaded on the unified controller;

an ANSI/CEA-709.1-B application conforming the ANSI standard protocol for control networking ANSI/CEA-709.1-B which allows the unified controller and the central air-conditioning system to communicate with each other according to the ANSI/CEA-709.1-B communication scheme; and an RS485 application which allows the unified controller and the multiple air-conditioning system to communicate with each other according to the RS485 communication scheme.

7. The system according to claim 5, wherein the middleware includes:

an Open Service Gateway Initiative (OSGI) ANSI/CEA-709.1-B system conforming the ANSI standard protocol for control networking ANSI/CEA-709.1-B which processes control messages between the unified controller and the central air-conditioning system;

an OSGI network system which processes control messages between the unified controller and the multiple air-conditioning system; and an embedded Java (J2ME).

8. The system according to claim 5, wherein the basic resource includes an embedded Database Management System (DBMS) and an embedded Operating System (OS).

9. A hybrid air-conditioning system comprising:

a Building Management System (BMS) controller which simultaneously manages a plurality of systems corresponding to individual arrangements of a building;

a multiple air-conditioning system which installs a plurality of indoor units connected to a single outdoor unit in individual air-conditioning rooms, and performs air-conditioning of the individual air-conditioning rooms according to a multiple air-conditioning scheme;

a central air-conditioning system which provides the individual air-conditioning rooms with air air-conditioned via an air-duct;

an unified controller which communicates with the individual air-conditioning systems simultaneously while being compatible with different communication schemes of the multiple air-conditioning system and the central air-conditioning system, and simultaneously controls an overall air-conditioning of the building; and a remote controller connected to the unified controller to remotely control the unified controller, wherein the remote controller is implemented with an Internet server or a personal computer.

10. A hybrid air-conditioning system comprising:

a Building Management System (BMS) controller which simultaneously manages a plurality of systems corresponding to individual arrangements of a building;

a multiple air-conditioning system which installs a plurality of indoor units connected to a single outdoor unit in individual air-conditioning rooms, and performs air-conditioning of the individual air-conditioning rooms according to a multiple air-conditioning scheme;

a central air-conditioning system which provides the individual air-conditioning rooms with air air-conditioned via an air-duct;

an unified controller which communicates with the individual air-conditioning systems simultaneously while being compatible with different communication schemes of the multiple air-conditioning system and the central air-conditioning system, and simultaneously controls an overall air-conditioning of the building; and a remote controller connected to the unified controller to remotely control the unified controller, wherein the remote controller is connected to the unified controller, so that it corrects errors of the unified controller, adds a new function to the unified controller, and updates pre-loaded functions of the unified controller.

11. A hybrid air-conditioning system comprising:

a Building Management System (BMS) controller which simultaneously manages a plurality of arrangements installed in a building;

a first air-conditioning system including a first air-conditioning system controller, which communicates with a first air-conditioning area of the building according to a first communication scheme and performs air-conditioning of the first air-conditioning area according to a multiple air-conditioning scheme;

a second air-conditioning system including a second air-conditioning system controller, which communicates with a second air-conditioning area of the building according to a second communication scheme and performs air-conditioning of the second air-conditioning area according to a central air-conditioning scheme; and an unified controller which is connected to the BMS controller and each of the first and second air-conditioning system controllers, and independently controls the first and second air-conditioning controllers.

12. The system according to claim 11, wherein the first communication scheme is an RS485 communication scheme.

13. The system according to claim 11, wherein the second communication scheme is a ANSI/CEA-709.1-B communication scheme conforming the ANSI standard protocol for control networking ANSI/CEA-709.1-B.

14. The system according to claim 11, wherein the first air-conditioning system performs air-conditioning of an outer area of a first building having an amount of cooling or heating load variation, and the second air-conditioning system performs air-conditioning of an inner area of a second building having an amount of cooling or heating load variation less than the amount of cooling or heating load variation of the outer area of the first building having.

15. The system according to claim 11, further comprising a remote controller which is connected to the unified controller, corrects errors of the first and second air-conditioning system controllers, adds a new function to them, and updates pre-loaded functions of them.

16. A method for controlling a hybrid air-conditioning system which includes a Building Management System (BMS) controller for simultaneously controlling a plurality of arrangements installed in a building and an unified controller for simultaneously controlling a plurality of air-conditioning systems of different types, the method comprising:

receiving, by the unified controller, at least one control message from controllers of the air-conditioning systems;

upon receiving the control message, determining category information of the received control message;

determining whether an air-conditioning operation of one air-conditioning system selected from among the air-conditioning systems is required or not according to the determined category information of the control message;

transmitting a message for operating or stopping the selected air-conditioning systems to a corresponding air-conditioning system according to a determined result;

controlling an air-conditioning operation upon receiving the message from the air-conditioning system;

if there is a need for a remote controller to be connected to the unified controller according to the determined category information of the control message, connecting the unified controller to the remote controller; and if the unified controller is connected to the remote controller, performing error correction of the unified controller, addition of a new function, and update of pre-loaded functions upon receiving a request from the remote controller.

17. The method according to claim 16, further comprising if the determined category information of the control message is a multiple air-conditioning system serving as one of the air-conditioning systems, performing the air-conditioning operation according to a multiple air-conditioning scheme using a plurality of indoor units, which are connected to a single outdoor unit and at least one of the indoor units is installed in individual air-conditioning rooms.

18. The method according to claim 16, further comprising if the determined category information of the control message is a central air-conditioning system serving as one of the air-conditioning systems, providing individual air-conditioning rooms with conditioned air via an air duct, and air-conditioning of the individual air-conditioning rooms according to a central air-conditioning scheme.

19. The method according to claim 16, wherein during the air-conditioning operation, the air-conditioning systems transmit control messages associated with sensor information detected by a sensor which detects environment information of individual air-conditioning rooms to the unified controller.

* * * * *

UNITED STATES PATENT AND TRADEMARK OFFICE

CERTIFICATE OF CORRECTION

PATENT NO. : 8,073,570 B2
APPLICATION NO. : 12/153604
DATED : December 6, 2011
INVENTOR(S) : Kim et al.

It is certified that error appears in the above-identified patent and that said Letters Patent is hereby corrected as shown below:

Title Page, Column 1 Item (75) (Inventors), Line 5, Delete "Hwanseong-si" and insert -- Hwaseong-si --, therefor.

Column 11, Line 21, In Claim 4, Delete "RS 485" and insert -- RS485 --, therefor.

Signed and Sealed this
Twenty-ninth Day of May, 2012

David J. Kappos

David J. Kappos
*Director of the United States Patent and Trademark Office*